US009726059B2

(12) United States Patent
Maus et al.

(10) Patent No.: US 9,726,059 B2
(45) Date of Patent: Aug. 8, 2017

(54) EXHAUST SYSTEM, MOTOR VEHICLE HAVING AN EXHAUST SYSTEM AND METHOD FOR OPERATING A MOTOR VEHICLE

(71) Applicant: EMITEC GESELLSCHAFT FÜR EMISSIONSTECHNOLOGIE MBH, Lohmar (DE)

(72) Inventors: Wolfgang Maus, Bergisch Gladbach (DE); Rolf Brueck, Bergis Gladbach (DE); Klaus Mueller-Haas, Cologne (DE)

(73) Assignee: EMITEC Gesellschaft fuer Emissionstechnologie mbH, Lohmar (DE)

( * ) Notice: Subject to any disclaimer, the term of this patent is extended or adjusted under 35 U.S.C. 154(b) by 0 days.

(21) Appl. No.: 13/854,355

(22) Filed: Apr. 1, 2013

(65) Prior Publication Data

US 2013/0305690 A1 Nov. 21, 2013

Related U.S. Application Data

(63) Continuation of application No. PCT/EP2011/067142, filed on Sep. 30, 2011.

(30) Foreign Application Priority Data

Oct. 1, 2010 (DE) ..... 10 2010 047 275

(51) Int. Cl.
*F01N 3/08* (2006.01)
*F01N 13/18* (2010.01)
*F01N 3/023* (2006.01)

(52) U.S. Cl.
CPC ..... *F01N 3/08* (2013.01); *F01N 3/0232* (2013.01); *F01N 13/1805* (2013.01);
(Continued)

(58) Field of Classification Search
CPC ..... F01N 13/1805; F01N 13/1822; F01N 3/0232; F01N 3/08; F01N 2290/08; F01N 3/023
(Continued)

(56) References Cited

U.S. PATENT DOCUMENTS 3,053,773 A 9/1962 Calvert
3,631,792 A * 1/1972 Bodine ..... 60/299
(Continued)

FOREIGN PATENT DOCUMENTS

DE 3502866 A1 3/1986
DE 3611768 A1 12/1986
(Continued)

OTHER PUBLICATIONS

Machine Translation to FR 2905726 A1.*

*Primary Examiner* — Mark Laurenzi
*Assistant Examiner* — Brandon Lee
(74) *Attorney, Agent, or Firm* — Laurence A. Greenberg; Werner H. Stemer; Ralph E. Locher

(57) ABSTRACT

An exhaust system includes at least one exhaust gas purification component, at least one exhaust line, at least one connecting device for connecting the exhaust system to an internal combustion engine of a motor vehicle and at least one fastening element for additionally fastening the exhaust system to the motor vehicle. The purification component can oscillate at a first resonance frequency range of less than 150 Hz in a fastened state. The purification component can oscillate due to vibrations of the engine at least when the engine is started or switched off. This, in particular, allows ash residues to be removed from a purification component during starting of the motor vehicle, so that maintenance expense for the purification component is reduced and effective operation thereof is possible over the long term. A
(Continued)

motor vehicle having an exhaust system and a method for operating the motor vehicle are also provided.

11 Claims, 1 Drawing Sheet

(52) U.S. Cl.
CPC ..... *F01N 13/1822* (2013.01); *F01N 3/023* (2013.01); *F01N 2290/08* (2013.01)

(58) Field of Classification Search
USPC ..... 60/274, 275, 295
See application file for complete search history.

(56) References Cited

U.S. PATENT DOCUMENTS

| | | | | |
|---|---|---|---|---|
| 5,323,989 | A | 6/1994 | Hamada et al. | |
| 5,614,155 | A * | 3/1997 | Abe et al. | 422/174 |
| 6,070,849 | A * | 6/2000 | Larmande et al. | 248/610 |
| 7,468,085 | B2 * | 12/2008 | Goddard | 55/385.3 |
| 2002/0157385 | A1 * | 10/2002 | Nakatani | B01D 46/0036 60/295 |
| 2004/0069562 | A1 | 4/2004 | Kondo et al. | |
| 2005/0077227 | A1 | 4/2005 | Kirker et al. | |
| 2007/0137150 | A1 | 6/2007 | Goddard | |
| 2007/0277512 | A1 | 12/2007 | Winsor | |

FOREIGN PATENT DOCUMENTS

| | | | |
|---|---|---|---|
| DE | 19946637 | A1 | 4/2001 |
| DE | 102006059291 | A1 | 6/2007 |
| DE | 102007024997 | A1 | 12/2008 |
| EP | 1865161 | A2 | 12/2007 |
| FR | 2905726 | A1 * | 3/2008 |
| JP | S59131220 | U | 9/1984 |
| JP | H04252732 | A | 9/1992 |
| JP | H10159540 | A | 6/1998 |
| JP | 3820894 | B2 | 9/2006 |

* cited by examiner

EXHAUST SYSTEM, MOTOR VEHICLE HAVING AN EXHAUST SYSTEM AND METHOD FOR OPERATING A MOTOR VEHICLE

CROSS-REFERENCE TO RELATED APPLICATION

This application is a continuation, under 35 U.S.C. §120, of copending International Application No. PCT/EP2011/067142, filed Sep. 30, 2011, which designated the United States; this application also claims the priority, under 35 U.S.C. §119, of German Patent Application DE 10 2010 047 275.1, filed Oct. 1, 2010; the prior applications are herewith incorporated by reference in their entirety.

BACKGROUND OF THE INVENTION

Field of the Invention

The present invention relates to an exhaust gas system having an exhaust-gas purification component, an exhaust line, a connection device and a fastening element. The present invention also relates to a motor vehicle having an exhaust system and a method for operating the motor vehicle.

Exhaust-gas purification components in exhaust systems of internal combustion engines may have different functions. The exhaust-gas purification components are used, for example, as catalyst carrier bodies, as adsorbers, as filters, as flow mixers and/or as particle separators. The exhaust-gas purification components typically have passages or channels through which a fluid can flow and which are, if appropriate, at least partially (catalytically) coated and/or formed with a filter material. The exhaust gas which flows into a channel may also, by using diverting structures, be caused to partially pass through the channel walls, in such a way that, for example, filter materials or separation surfaces for particles and/or intimate contact with a catalytically active surface are realized. The deposited soot particles, ash and/or carbon particles can be at least intermittently converted by using high exhaust-gas temperatures, in the presence of $NO_2$ (nitrogen dioxide) and/or by using a catalytically active coating.

However, situations arise in which the deposited soot particles and/or carbon particles or the ash are not completely converted. If such unconverted residues collect in the filter material and/or on the channel walls, in particular at the transition points between the adjacent channels, an exhaust-gas purification component can become at least partially blocked. That leads to an increased pressure drop of the exhaust gas across the exhaust-gas purification component and thus to a decrease in efficiency of the internal combustion engine. Furthermore, the catalytically active surface can be at least partially covered and thus reduced in that way, which is likewise undesirable.

SUMMARY OF THE INVENTION

It is accordingly an object of the invention to provide an exhaust system, a motor vehicle having an exhaust system and a method for operating a motor vehicle, which overcome the hereinafore-mentioned disadvantages and at least partially solve the highlighted problems of the heretofore-known systems, vehicles and methods of this general type and, in particular, to specify an exhaust system with which particles (such as, for example, ash) that cannot be converted into gaseous substances can be eliminated from critical regions of the exhaust system.

With the foregoing and other objects in view there is provided, in accordance with the invention, an exhaust system, comprising at least one exhaust-gas purification component, at least one exhaust line, at least one connector or connection device for connecting the exhaust system to an internal combustion engine of a motor vehicle, and at least one fastener or fastening element for additionally fastening the exhaust system to the motor vehicle. The at least one exhaust-gas purification component can, in a fastened state, be stimulated to perform oscillations with a first resonance frequency range of lower than 300 Hz [1/sec], preferably lower than 150 Hz and the exhaust-gas purification component can, in a fastened state, preferably be stimulated to perform oscillations with a first resonance frequency range of at least 50 Hz.

An exhaust-gas purification component is to be understood, in particular, to mean at least one of the following components: honeycomb body, filter, separator, catalyst carrier body, adsorber or flow mixer. The exhaust-gas purification components are disposed in the exhaust line or in an exhaust-gas recirculation line of the exhaust system assigned to an internal combustion engine, and are thus exposed to the exhaust gas. For this purpose, the exhaust-gas purification component is, for example, connected in a force-locking and/or form-locking and/or cohesive fashion, or is in contact, with the exhaust line. A force-locking connection is one which connects two elements together by force external to the elements, as opposed to a form-locking connection which is provided by the shapes of the elements themselves.

A connector or connection device is to be understood to mean elements by which the exhaust system is directly connected to, or placed in contact with, the internal combustion engine. The connection device may be in the form of a flange which is screwed to the internal combustion engine. The connection device may, however, also be realized by using a welded connection of the exhaust system to the internal combustion engine. The connection device is normally adjoined by the exhaust line through which the exhaust gas is conducted and in which the at least one exhaust-gas purification component is disposed. The exhaust system is connected to the motor vehicle by at least one further fastener or fastening element. The at least one fastening element can produce a rigid or elastic connection of the exhaust system to the motor vehicle. The at least one fastening element is, in particular, provided on the underside of the motor vehicle and includes, for example, at least one bracket which, at a distance from the internal combustion engine, fixes the exhaust system in the desired position.

A fastened state is to be understood, in particular, to mean that the exhaust system is clamped at the connection device and at the at least one fastening element corresponding to the intended use situation. In order to determine the resonance frequency, the exhaust system is thus either mounted as intended in a motor vehicle or else is clamped in a test stand in the same way as in the intended use situation.

The resonance frequencies of the at least one exhaust-gas purification component of the exhaust system may, on one hand, be determined by using numerical methods in simulations. Furthermore, experimental determination of the resonance frequencies of the exhaust-gas purification components disposed in the exhaust system is also possible. For this purpose, the exhaust system, clamped in the same way as during operation of the internal combustion engine is, for example, stimulated in up to three (3) mutually orthogonal directions in succession, with an amplitude of at least 1 mm

[millimeter] in the spatial direction, by an oscillation source. The oscillation source passes through a stimulation frequency of, for example, 1 Hz up to 16,000 Hz. In order to determine the resonance frequency, an oscillation amplitude is recorded at different points of the exhaust system, in particular at the exhaust-gas purification components, as a function of the stimulation frequency. The frequency at which the maximum amplitudes are determined is referred to as the resonance frequency.

A resonance frequency range refers to a frequency interval with a width of 10 Hz, preferably 5 Hz, particularly preferably 2 Hz, which centrally surrounds the resonance frequency. Alternatively, the resonance frequency range may be determined by using the half width of the resonance frequency in a plot of the oscillation amplitude versus stimulating frequency, wherein the resonance frequency range corresponds to at most 10 times, preferably at most 5 times and particularly preferably at most 3 times the half width.

The exhaust system can be stimulated to perform oscillations by vibrations. The oscillations may be distinguished, at a predefined location of the exhaust system, by an amplitude and a frequency. In this case, the amplitude and the frequency need not correspond at all locations of the exhaust system. Oscillations with frequencies in a first resonance frequency range are, in particular, oscillations which are performed by an exhaust-gas purification component as a whole, that is to say in particular oscillations with which a housing of the exhaust-gas purification component oscillates out of its rest position. All of the parts of the exhaust-gas purification component also oscillate together with the oscillations of the housing out of its rest position. Parts mounted in the housing in a damped manner may oscillate with a smaller amplitude than the housing itself. It is, however, preferable for oscillations with a frequency in the first resonance frequency range to be transmitted in an undamped manner to all of the parts. It is, however, also conceivable for rigid structures of the exhaust-gas purification system, such as for example the housing, to oscillate with a relatively small amplitude, whereas flexible elements of the exhaust-gas purification component, such as for example the filter material, oscillate with a larger amplitude. The oscillations of the exhaust-gas purification component thus also stimulate the ash particles and/or soot particles deposited in the exhaust-gas purification component to perform oscillations. Due to the mass inertia of the particles which differs from that of the accumulation site, the deposited particles can detach from the accumulation site and pass, for example, back into the exhaust-gas flow.

As a result of a stimulation of the exhaust-gas purification component with a frequency in the first resonance frequency range, the exhaust-gas purification component performs oscillations with a large amplitude, whereby the particles are detached from their accumulation sites.

In accordance with another feature of the invention, a first resonance frequency range of lower than 300 Hz and, in particular, of lower than 150 Hz is selected in such a way that at least one exhaust-gas purification component can be stimulated to perform oscillations by vibrations of the internal combustion engine at least during starting or shut-down of the internal combustion engine. Since, during starting, the internal combustion engine passes through frequencies of 0 Hz up to frequencies of 300 Hz, which can be assigned to the idle rotational speed, the exhaust-gas purification component is cleaned by the vibrations at least once during the operation of the internal combustion engine. If the resonance frequency range is higher than 50 Hz, a stimulation of oscillations of the exhaust-gas purification component by oscillations caused by uneven road surfaces during a trip is prevented.

In accordance with a further feature of the invention, frequencies from the first resonance frequency range are preferably attained by way of the construction of at least two of the following components:

connection device,
fastening element,
mass of the exhaust-gas purification component,
exhaust line.

In particular, the mechanical properties of the above-mentioned components are coordinated (with one another) in such a way that a first resonance frequency range of lower than 300 Hz or even lower than 150 Hz is realized. The mechanical properties refer, in particular, to the mass, the bending stiffness, the modulus of elasticity of the components and/or the connecting points thereof.

The at least one exhaust-gas purification component preferably has channels, through which a fluid can flow and which have walls formed at least partially with filter material, and a multiplicity of structures which project into the channels. By using an exhaust-gas purification component constructed in this way, the fluid flowing in a channel can flow to an adjacent channel through a filter material which captures the particle and/or the ash. In a preferred embodiment, the channels are disposed in a layered fashion. The exhaust gas can thus be diverted in two mutually orthogonal directions. It is advantageous in this case for the at least one exhaust-gas purification component to oscillate in at least one of the diverting directions. It is thus possible for the soot particles and/or carbon particles deposited in the filter material to be accelerated in both directions from the rest position toward a channel. The "open" embodiment of a particle separator of that type has the advantage that the ash can also be removed by virtue of its being conveyed to the open outlet by vibration and exiting the particle separator. Reference is made to known patent publications of the Applicant of the instant application for a more detailed description of the so-called open partial-flow filter. In this regard, reference is made, in particular, to International Publication No. WO 02/00326 A2, corresponding to U.S. Pat. No. 6,712,884 or to International Publication No. WO 2005/099867 A1, corresponding to U.S. Pat. No. 7,959,868, the content of which can be taken into consideration for the characterization of the open partial-flow filter.

In accordance with an added feature of the exhaust system of the invention, the at least one exhaust-gas purification component has at least one part which has a second resonance frequency range of higher than 500 Hz, preferably of higher than 800 Hz, particularly preferably of higher than 1000 Hz. In contrast to the first resonance frequency range, which distinguishes the behavior of the fastened exhaust-gas purification component in the exhaust system, the second resonance frequency range distinguishes a part of the exhaust-gas purification component itself. The parts of the at least one exhaust-gas purification component are, in particular, the structures and/or the walls of the channels, in particular the filter material. The second resonance frequency range thus lies outside the vibration frequencies normally generated by an internal combustion engine. The parts of the exhaust-gas purification component therefore cannot be stimulated to perform oscillations by the internal combustion engine alone (that is to say, in particular, without a corresponding resonance oscillation of the exhaust line in that range), so that an undesired stimulation of the parts to perform oscillations during a trip is avoided.

The second resonance frequency range is, in particular, determined by virtue of the clamped exhaust-gas purification component being stimulated with vibrations, wherein the oscillations of the individual parts are recorded as a function of the frequency of the stimulating oscillations.

In accordance with an additional advantageous feature of the invention, the at least one exhaust-gas purification component is assigned a vibration element which can stimulate the exhaust-gas purification component to perform oscillations with a frequency in the second resonance frequency range. As a result of the oscillations, the particles deposited in the exhaust-gas purification component are detached from the accumulation sites. Additionally to the vibrations generated by the internal combustion engine during starting or shut-down, the exhaust-gas purification component can be cleaned in a targeted manner during the operation of the internal combustion engine by using the vibration element.

With the objects of the invention in view, there is also provided a motor vehicle, comprising an exhaust system according to the invention.

With the objects of the invention in view, there is concomitantly provided a method for operating a motor vehicle having an internal combustion engine and an exhaust system. The method comprises, during a starting process, operating the internal combustion engine in such a way that vibrations of the internal combustion engine are stimulated for such a length of time that the vibrations are transmitted to an exhaust-gas purification component which is stimulated to perform oscillations in a resonance frequency range of lower than 150 Hz, so that it is freed from particles. Such a method is realized, in particular, by virtue of the injection time and the injection duration being selected correspondingly during the starting of the engine.

Other features which are considered as characteristic for the invention are set forth in the appended claims, noting that the features specified individually in the dependent claims may be combined with one another in any desired technologically meaningful way and define further embodiments of the invention. Furthermore, the features specified in the claims are rendered more precisely and explained in more detail in the description, with further preferred refinements of the invention being presented.

Although the invention is illustrated and described herein as embodied in an exhaust system, a motor vehicle having an exhaust system and a method for operating a motor vehicle, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
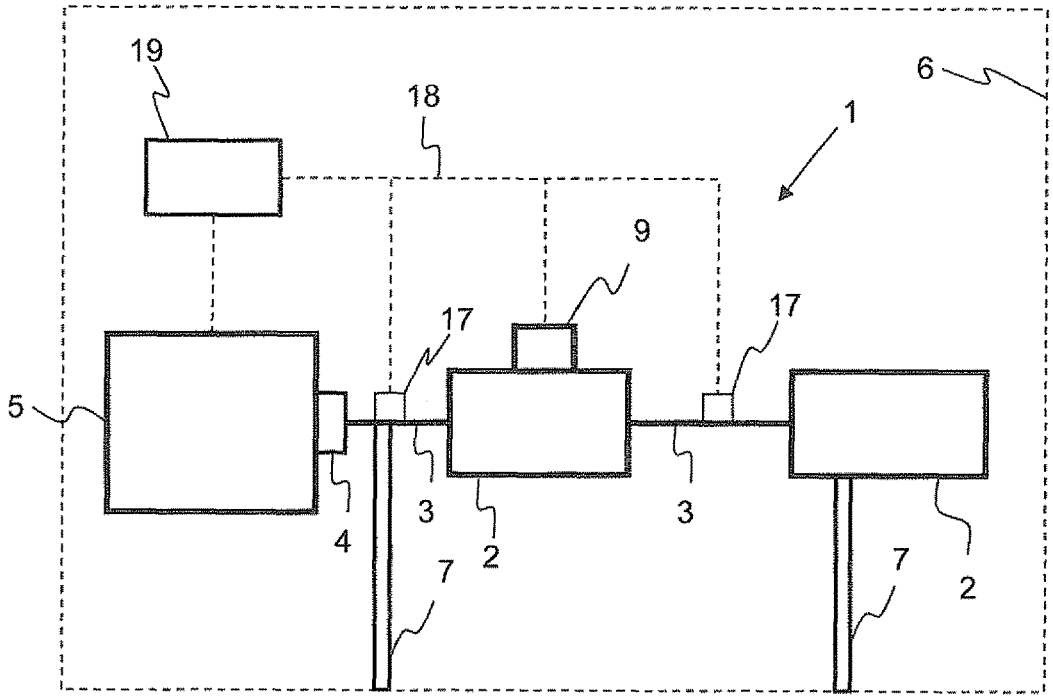
FIG. 1 is a block diagram of a motor vehicle having an exhaust system according to the invention.

Referring now to the figures of the drawings in detail and first, particularly, to FIG. 1 thereof, there is seen a motor vehicle 6 having an internal combustion engine 5 and an exhaust system 1. The exhaust system 1 has an exhaust line 3 with two (integrated) exhaust-gas purification or treatment components 2, a connector or connection device 4 and two fasteners or fastening elements 7. The exhaust system 1 is connected by the connection device 4 to the internal combustion engine 5 and is additionally connected by the fastening elements 7 to the motor vehicle 6. Detectors 17, which are also disposed on the exhaust line 3, are connected through data lines 18 to a control unit 19. A vibrator or vibration element 9, which is also associated with one of the exhaust-gas purification components 2, is likewise connected through the data line 18 to the control unit 19. The control unit 19 is furthermore connected to the internal combustion engine 5.

The mechanical properties of the exhaust-gas purification component 2, of the exhaust line 3, of the connection device 4 and of the fastening element 7, are coordinated with one another in such a way that at least one exhaust-gas purification component 2 has a first resonance frequency range of below 300 Hz or even below 150 Hz, but above 50 Hz. It is ensured in this way that, during the starting of the internal combustion engine 5, as a result of transmitting the vibrations of the internal combustion engine 5 to the exhaust system 1, the at least one exhaust-gas purification component 2 is stimulated to perform oscillations or excited to oscillate, in such a way that particles deposited in the exhaust-gas purification component 2 are detached. A stimulation of oscillations as a result of uneven road surfaces during a journey is, however, prevented. A stimulation of the exhaust-gas purification component 2 to perform oscillations while the internal combustion engine 5 is at idle and/or under load can thus likewise practically be prevented (if desired). During the starting of the internal combustion engine 5, the control unit 19 controls injection processes in such a way that preferably oscillations with frequencies from a first resonance frequency range are stimulated.

The detectors 17 determine parameters of the exhaust gas, such as pressure, temperature and/or exhaust-gas composition, in the exhaust line 3 and transmit these to the control unit 19. The control unit 19 can, after predefined intervals and/or in the presence of predefinable parameters of the internal combustion engine 5 and/or in the presence of predefinable parameters of the exhaust gas, transmit a signal for performing vibrations to the vibration element 9. The vibration element 9 performs, in particular, oscillations with frequencies higher than 500 Hz [1/sec]. The frequency of the stimulating oscillation can thus be set in such a way that the exhaust-gas purification component 2 is stimulated with a frequency in a second resonance frequency range of parts 8 of the exhaust-gas purification component 2 shown in FIG. 2. The exhaust-gas purification component 2 may be stimulated in an alternating manner with different frequencies by the vibration element 9. In this case, the stimulating amplitude of the vibration element 9 is preferably less than 1 mm. In this case, the vibration of the exhaust-gas purification component 2 is performed during the operation of the internal combustion engine 5, in such a way that particles which have been deposited in the exhaust-gas purification component 2 and which have not been converted during a regeneration are detached and entrained by the exhaust-gas flow of the internal combustion engine. The vibration element 9 may, for example, be a piezoelectric element or an electric motor.

Figure 2:
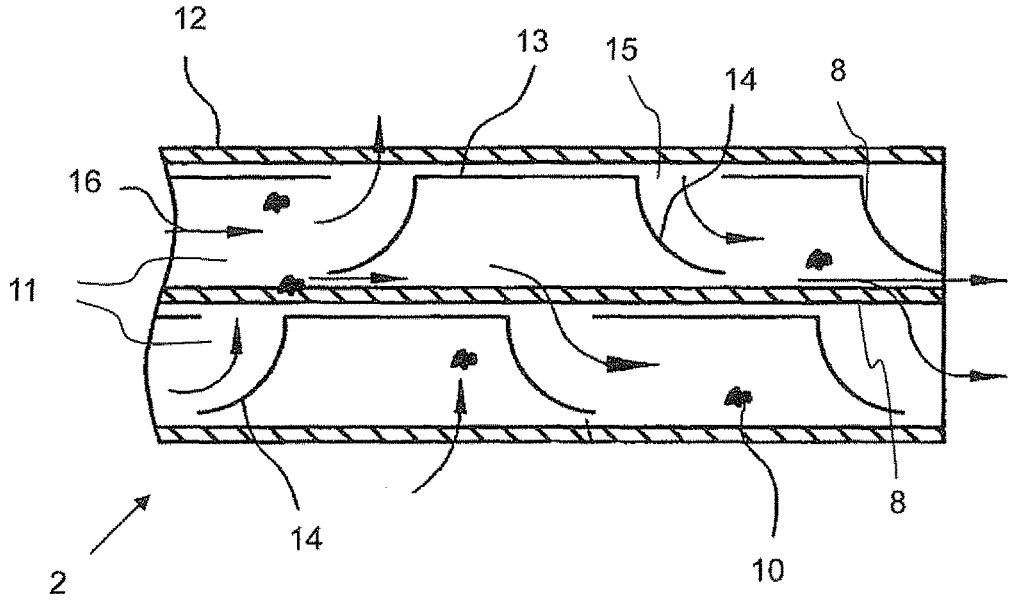
FIG. 2 is a fragmentary, diagrammatic, longitudinal-sectional view of an exhaust-gas purification component.

FIG. 2 shows a portion of an exhaust-gas purification component 2. The exhaust-gas purification component 2 has channels 11 into which the exhaust gas flows in an original flow direction 16. The channels 11 are formed by channel walls 13 which have passages 15 and which are formed partially by filter material 12. Furthermore, the channel walls 13 may have structures 14 (for example corrugated metal foils) which divert the exhaust gas. Arrows indicate the flow direction of the exhaust gas. The exhaust gas carries particles 10 with it and is diverted by the structures 14 in such a way that the particles 10 can be deposited in the filter material 12. In general, during the regeneration of the exhaust-gas purification component 2, soot particles and ash are converted into carbon dioxide and nitrogen. A situation may, however, arise in which the conversion does not take place completely, and as a result, the filter material 12 and/or the passages 15 become blocked. Such a blockage may possibly increase the pressure drop across the exhaust-gas purification component 2. As a result of the stimulation of the exhaust-gas purification component 2 to perform vibrations during the starting or shut-down of the internal combustion engine 5, the deposited particles 10 can detach and pass back into the exhaust-gas flow. A blockage of the exhaust-gas purification component 2 is thus prevented in an effective manner.

The present invention permits, in particular, the removal of ash residues from an exhaust-gas purification component 2 during the starting of the motor vehicle 6, in such a way that the maintenance expenditure for such an exhaust-gas purification component is reduced and long-term effective operation of the exhaust-gas purification component 2 is possible.

The invention claimed is:

1. An exhaust system, comprising:

at least one exhaust-gas purification component;

at least one exhaust line connected to said at least one exhaust-gas purification component;

at least one connector configured to connect said at least one exhaust line to an internal combustion engine of a motor vehicle; and at least one fastener configured to additionally fasten the exhaust system to the motor vehicle;

in an installed state of the exhaust system in the motor vehicle, mechanical properties of said at least one exhaust-gas purification component, said at least one exhaust line, said connector and said at least one fastener being coordinated with one another for setting a first resonance frequency range of said at least one exhaust-gas purification component between 50 to 300 Hz for freeing said at least one exhaust-gas purification component from particles.

2. The exhaust system according to claim 1, wherein said at least one exhaust-gas purification component is configured to be stimulated to perform oscillations with the first resonance frequency range by vibrations of the internal combustion engine at least during start-up or shut-down of the internal combustion engine.

3. The exhaust system according to claim 1, wherein at least two of the following components have a construction permitting said components to attain resonance frequencies from the first resonance frequency range:

said at least one connector, said at least one fastener, said at least one exhaust-gas purification component, or said at least one exhaust line.

4. The exhaust system according to claim 1, wherein said at least one exhaust-gas purification component has at least one part having a second resonance frequency range of higher than 500 Hz.

5. The exhaust system according to claim 4, which further comprises a vibrator associated with said at least one exhaust-gas purification component and configured to stimulate said at least one exhaust-gas purification component to perform oscillations with a frequency in the second resonance frequency range.

6. The exhaust system according to claim 1, wherein said at least one exhaust line is one exhaust line extending in a single direction and being connected to said at least one exhaust-gas purification component.

7. The exhaust system according to claim 1, wherein said at least one exhaust-gas purification component includes channels delimited by filter material being permeable to exhaust gas.

8. A motor vehicle, comprising:

an internal combustion engine; and an exhaust system connected to said internal combustion engine, said exhaust system including:

at least one exhaust-gas purification component;

an exhaust line extending between and being connected to said internal combustion engine and said at least one exhaust-gas purification component;

at least one connector configured to connect the exhaust system to said internal combustion engine; and at least one fastener configured to additionally fasten the exhaust system to the motor vehicle;

in an installed state of the exhaust system in the motor vehicle, mechanical properties of said at least one exhaust-gas purification component, said at least one exhaust line, said connector and said at least one fastener being coordinated with one another for setting a first resonance frequency range of said at least one exhaust-gas purification component between 50 to 300 Hz for allowing said internal combustion engine to free particles from said at least one exhaust-gas purification component during idling of said internal combustion engine.

9. The motor vehicle according to claim 8, wherein said at least one exhaust-gas purification component includes channels delimited by filter material being permeable to exhaust gas, and said exhaust line is one exhaust line extending in a single direction.

10. A method for operating a motor vehicle having an internal combustion engine and an exhaust system, the method comprising the following steps:

providing at least one exhaust line;

connecting an internal combustion engine to one end of the at least one exhaust line;

connecting an exhaust-gas purification component along the at least one exhaust line;

connecting at least one connector and at least one fastener configured for fastening the at least one exhaust line to the motor vehicle; and during a starting process, vibrating the internal combustion engine with the exhaust-gas purification component, the at least one exhaust line, the at least one connector, and the at least one fastener being coordinated with one another for generating a first resonance frequency range between 50 to 150 Hz in the exhaust-gas purification component for a length of time, and freeing the exhaust-gas purification component from particles.

11. The method according to claim 10, wherein the exhaust-gas purification component includes channels delimited by filter material being permeable to exhaust gas, and the at least one exhaust line is one exhaust line extending in a single direction.

* * * * *